United States Patent [19]

Davis et al.

[11] 4,395,029

[45] Jul. 26, 1983

[54] FIXTURE FOR MANUFACTURING RATTAN TYPE FURNITURE

[75] Inventors: Denny G. Davis, Littleton; Robert C. Emerson, Aurora; George J. Banks, Jr., Littleton, all of Colo.

[73] Assignee: Almar Products Corporation, Calif.

[21] Appl. No.: 215,253

[22] Filed: Dec. 11, 1980

[51] Int. Cl.[3] ..... B65H 81/00

[52] U.S. Cl. ..... 269/57; 269/71; 269/76; 269/296; 269/901; 156/425; 156/175

[58] Field of Search ..... 269/57, 58, 59, 76, 269/296, 38, 71, 901, 902; 156/425, 175; 118/500, 502, 503; 242/7.21

[56] References Cited

U.S. PATENT DOCUMENTS

| | | | |
|---|---|---|---|
| 3,140,058 | 7/1964 | Courtney | 156/175 |
| 3,309,185 | 3/1967 | Weber | 156/175 |
| 3,649,401 | 3/1972 | Gunnerson | 156/175 |
| 3,881,715 | 5/1975 | Creek | 269/902 |
| 4,289,564 | 9/1981 | Hanaford et al. | 156/425 |

*Primary Examiner*—Robert C. Watson

*Attorney, Agent, or Firm*—Robert W. Dilts

[57] ABSTRACT

A plurality of knock-down C-shaped frame members, adjustably supporting a pair of spaced apart furniture manufacturing jig frame members in each C-frame, provides a plurality of rotatable, clear span assemblies for weaving a plurality of rattan-type fibers from each jig frame member to its juxtaposed jig frame member, and arranged to hold the jig frame members in their spaced position during the hardening of fibers, which secures such fibers in a rattan furniture frame shape. The unit provides an easily assembled and disassembled multiple station, furniture base manufacturing assembly.

1 Claim, 4 Drawing Figures

FIXTURE FOR MANUFACTURING RATTAN TYPE FURNITURE

This invention relates to a fixture for rotatably holding furniture jig frame members in position for forming woven lattice, wicker or rattan-type furniture frames therebetween with a rotatable jig having a clear span between the jig frame members.

BACKGROUND

Various furniture parts are of a pedestal-type for supporting a somewhat planar member, for example a table top, a seat or the like. One commonly used material for making a pedestal type furniture portion is an elongated cord-like material, such as rattan. This material is of a long fiber and is formed into a cord-like length which is formed into a lattice work pedestal. The rattan fiber is woven while green, and upon drying it becomes stiff and supports itself in the woven lattic work. The lattice work pedestal forms the base for many different types of furniture, with a planar member secured to the upper and lower ends of the pedestal. Such furniture uses the pedestal type frames of circular or ovate form for tables, chairs, bassinettes, etc.

The conventional jig or manufacturing frame structure is a single station unit including a central shaft, mounted on a base, in upright position, which shaft holds a pair of spaced, generally planar frame members. Each planar frame member is provided with pins around its peripheral edge so that the cordlike fiber may be woven into a lattice-type structure. Such a jig or frame is shown in United States Patent No. 3,649,401 dated Mar. 24, 1972 to Gunnerson. The device of this patent requires a central mandrel to support a pair of spaced apart, relatively thin planar frame members. The device must be dismantled to remove the manufactured piece. The cord-like filament, when cured holds itself in shape and the removable pins are removed from holes on the periphery of the planar frame members. The central member is removed so as to remove the top and bottom members.

OBJECTS AND ADVANTAGES OF THE INVENTION

Included among the objects and advantages of the invention is to provide an easily disassemblable multiple station manufacturing frame for wicker-type furniture components.

Another object of the invention is to provide a manufacturing frame for wicker-type of furniture with prepositioned upper and lower pin holding planar frames, which are adjustable to accommodate different sizes of furniture and different types of lattice-work pieces.

Other objects of the invention is to provide a multiple station, rattan-type manufacturing frame for supporting upper and lower pin frames without intervening structure, the plural stations being arranged for moving from a manufacturing position to a holding and curing positions, rotatable stations for ease of manufacturing procedure, and simple and easy means to use the manufacturing interconnected stations.

These and other objects may be ascertained by referring to the following description and appended drawings.

GENERAL DESCRIPTION OF THE ILLUSTRATIONS

SPECIFIC DISCLOSURE OF THE DRAWINGS

Figure 1:
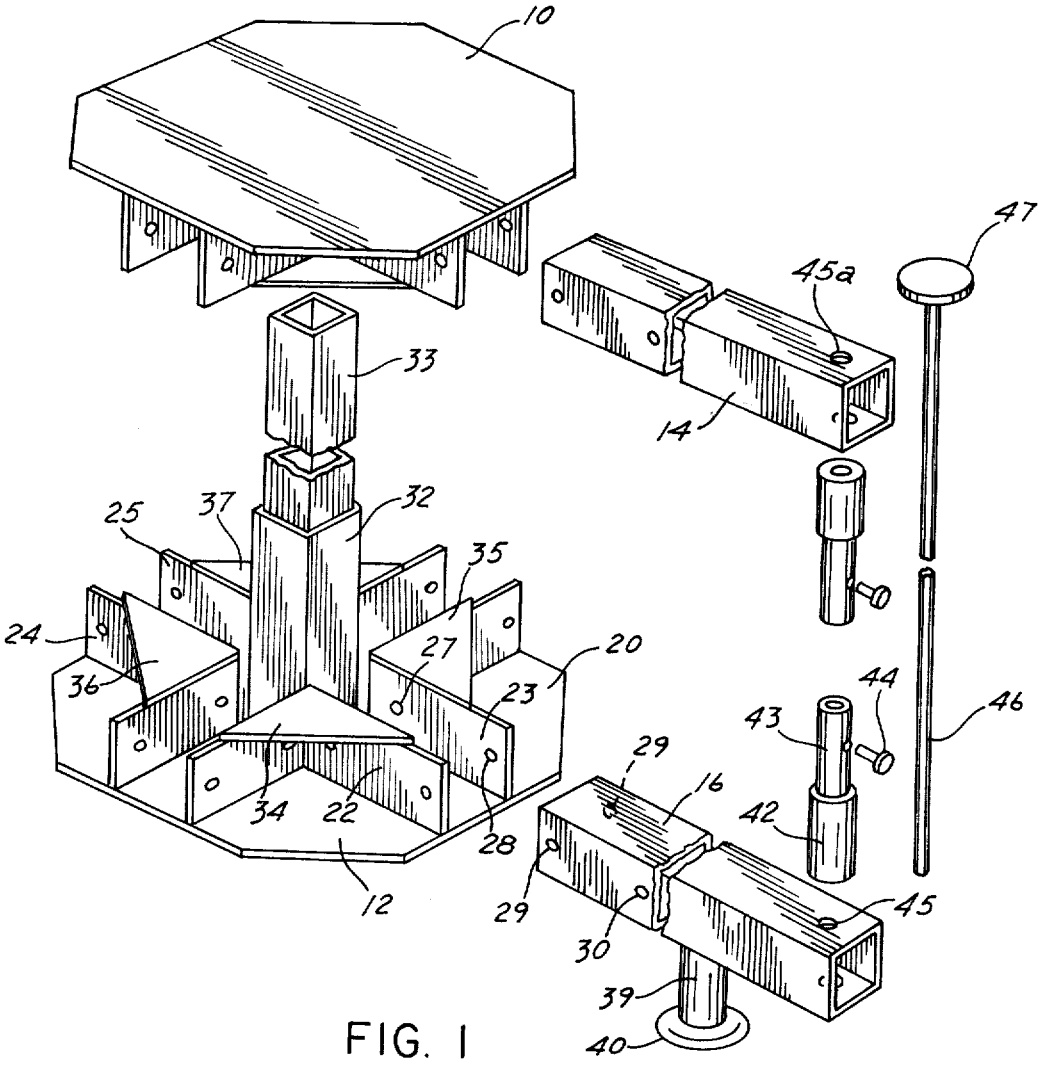
FIG. 1 is an exploded perspective of a portion of one form of multiple stations manufacturing frame for rattan-type furniture.
Figure 2:
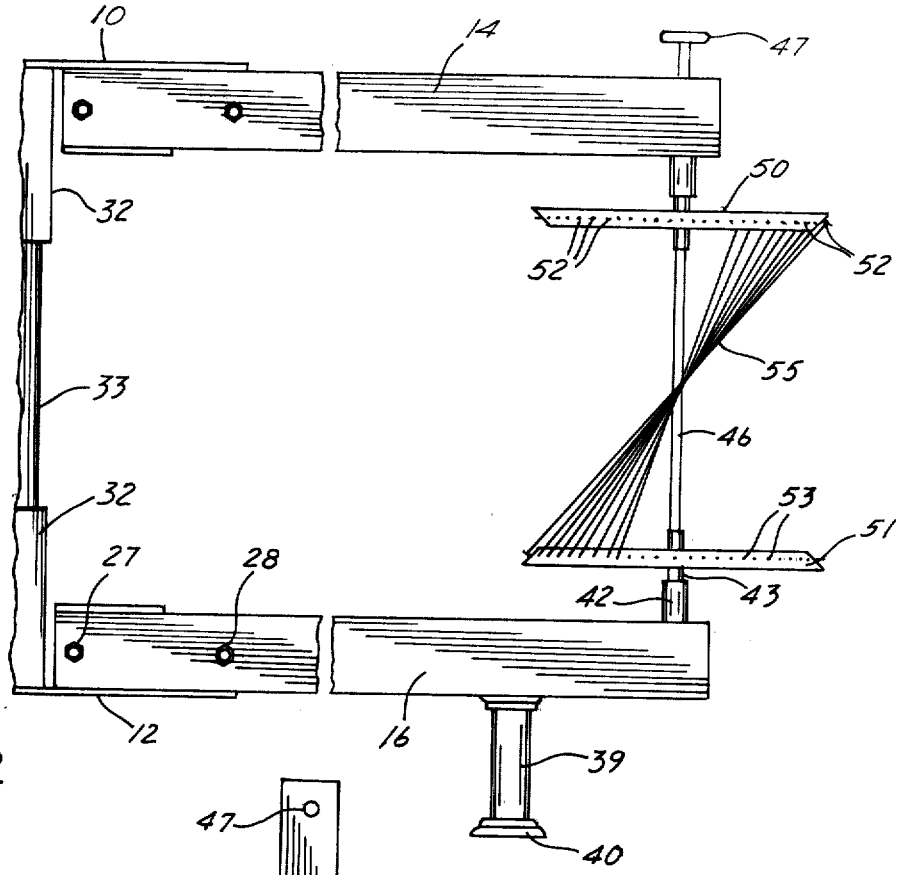
FIG. 2 is a side elevational view of an assembled station of the device of FIG. 1.
Figure 3:
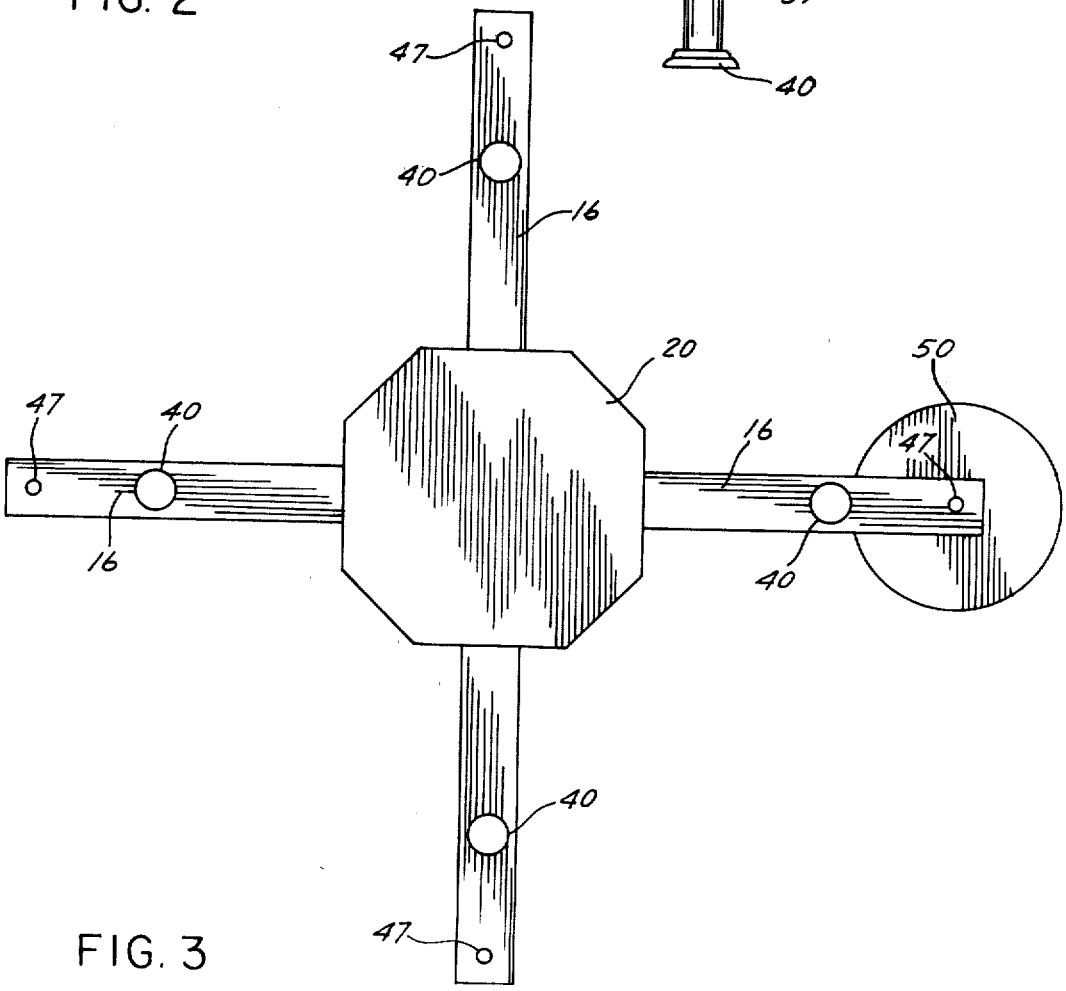
FIG. 3 is a top view of the assemble multiple stations unit.

In the preferred form of manufacturing frame shown in FIGS. 1-3, an easily assembled and disassembled unit includes upper 10 and lower 12 center frame assemblies. The assemblies are arranged to releasably support extending upper 14 and lower 16 arm assemblies. The center assemblies are identical and may be used in either position. In describing the lower unit, the upper unit is described. The lower unit includes a plate 20, of octagonal shape. The plate for one size of unit is a metal plate of ¼ inch steel of orginally 24×24 inch size with the corners cut off. The arm supports are formed of angles welded to the plate. Two spaced flanges of the angles form the leg supports, with the leg releasably secured by bolts. Thus, angle 22 is welded in upright position on plate 20, and angles 23 and 24 are welded in spaced relation so as to leave a leg width slot therebetween. Holes 27 and 28 in the angles mate with holes 29 and 30 in the arm 16. Bolts (not shown) are placed through the aligned holes so as to releasably secure the arms in place. Each set of spaced angles are arranged with an arm slot for holding 4 arms at right angles. A central square tube or socket member 32 welded to the plate 20 is arranged to releasably hold a square tubular support 33. A set screw (not shown) may be threaded in a bore in the tube (not shown) to hold the tube onto the center assembly. The length of the tube 33 is predetermined to the size of furniture to be made.

The center assembly is strengthened by the use of gussets welded across the angles to give support to the arms. Thus a gusset 34 is welded across the angle 22 and gusset 35 is welded across the angle 23. In a like manner gusset 36 is welded across the angle 24 and gusset 37 is welded across angle 25.

Each arm includes a leg and a base contacting foot so that they are interchangeable in any position. Arm 16 includes a leg 39 welded to the lower plate of the arm tube and foot 40 is threadedly secured to the leg. The foot is adjustable on the leg to permit the leveling of the unit. Associated with each arm is a rotatory torque rod holder 42, which also supports a furniture jig member. Arm 16 includes a bore 45 (extending through the arm). The rotary torque rod holder 42 also includes a jig support portion 43 secured in the holder 42, and a set screw 44 is arranged to secure a torque rod 46 therein. The upper arm includes the same elements, and the torque rod 46, having a head 47, may be passed through bore 45*a* in arm 14 through the upper holder and lower holder 42 and into the bore 45 in arm 16. The rod 46 is secured in the holders 42 by means of the set screws 44 for rotation therewith.

For use, the 4 station unit is assembled with the 4 pairs of arms. A planar jig form 50, with a plurality of pin holes 52 is secured to the upper rotary torque rod holder 42 so as to rotate therewith. A planar jig form 51, with pin holes 53 in its periphery, is secured on lower rotary torque rod holder 42. The torque rod 46 is positioned in both rotary members and secured therein so as to cause both rotary members to rotate conjointly. Pins are placed in the pin holes, and the rattan-type material 55 is woven between the pins of the upper jig to the pins in the lower jig, conventionally at an angle.

The jig form discs, in the form shown, are truncated circular cones to provide a sloping peripheral surface for the pin holes, permitting the weaving of a filament from the pins of upper disc to the lower disc pins providing an uninterrupted run from pin to pin. Of course, different sizes of furniture, and different types of furniture dictate the amount of slope of the peripheral surface of each disc, and the discs are prepared for the particular desired furniture. Also, the size dictates the length of the center square tube, and the torque rod.

Figure 4:
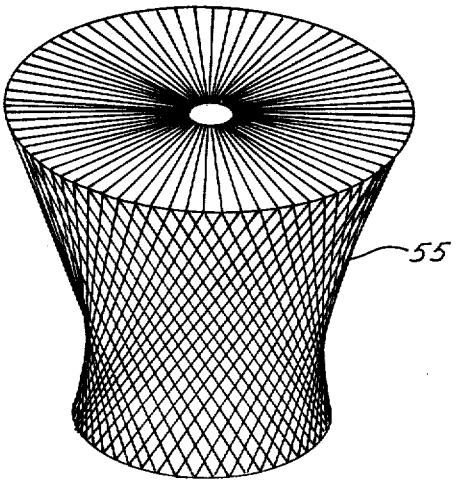
FIG. 4 is perspective view of a table formed of lattice-work filament.

The wicker or lattice-work furniture may be made with a filament of glass fiber and this may be coated with a synthetic resin, in liquid form, prior to laying up the filament, in the woven pattern, on the pins on the two discs. The woven filament is woven around the pins at a slant, for example filaments 55 of FIG. 4, showing criss-cross of the filaments to form the lattice work of filament for the base of a table. When the filament is coated before the weaving with the liquid resin, the completed lattice-work on the discs is permitted to cure to form a hardened lattice framework or pedestal for the furniture. A top and bottom is subsequently secured to the base to form the type of furniture desired.

The unit is preferably used as a multiple station furniture making unit, by providing jig form discs on aligned rotary torque rod holders, and weaving filament over the pins. Once the one base is finished, that station may be left intact, for permitting the lattice-work filament to cure into a rigid self supporting framework. The same procedure is followed for each station. When cured, the pins are withdrawn from the holes, and each lattice base member is removed from the assembly by pulling the torque rods, and raising the top frame assembly. Once free from the manufacturing assembly, the jig discs may be removed from the base. A top and bottom furniture disc, either solid or woven and hardened is then secured over the openings formed by disc removal. The furniture discs are secured to pedestal lattice work by cement, resin or the like. Additional members may be added, e.g. chair backs, etc.

What is claimed is:

1. A rattan type furniture manufacturing assembly comprising:

(a) a pair of interchangeable base members each comprising a flat plate having four angle members secured to one major surface thereof to define four arm holding supports with a square socket member secured to and projecting normally from said one major surface in given orientation with respect to said arm holding supports, (b) eight interchangeable arm means in the form of square cross-section tubes each removably secured in a different one of said arm holding supports of said two base members with the four arm means secured to each of said base members extending outwardly thereof at right angles to each other, (c) a square central shaft having each of its ends releasably received with a close fit in a different one of said square socket members of said pair of base members for supporting said base members apart with said arm means of one of said base members in alignment with said arm means of the other of said base members, (d) four torque rods each rotably received through bores in a different aligned pair of said arm means at the free end thereof, (e) a plurality of hollow tubular disc holding means each receiving a different one of said torque rods and being releasably secured thereto, and (f) adjustable foot means mounted on each of said arm means of one of said base members at the free end thereof and projecting axially outward of said assembly, whereby said assembly may be supported on said foot means when associated with either one of said base members with said central shaft and said torque rods extending vertically.

* * * * *